United States Patent [19]

Kim et al.

[11] 4,450,204

[45] May 22, 1984

[54] SILVER MATERIAL SUITABLE FOR BACKING OF SILVER-CADMIUM OXIDE CONTACTS AND CONTACTS EMPLOYING SAME

[75] Inventors: Han J. Kim, Greensburg; Richard C. Bevington, Delmont, both of Pa.

[73] Assignee: GTE Products Corporation, Stamford, Conn.

[21] Appl. No.: 383,416

[22] Filed: Jun. 17, 1982

[51] Int. Cl.[3] ..... B22F 7/02

[52] U.S. Cl. ..... 428/552; 75/232; 75/234; 419/6; 419/21; 419/38; 200/265; 200/266; 200/267; 200/268

[58] Field of Search ..... 75/232, 235, 233, 234; 200/265, 266, 268, 267; 419/21, 6, 38; 428/552

[56] References Cited

U.S. PATENT DOCUMENTS 3,510,935 5/1970 Dürrwächter et al. ..... 419/6

3,969,112 7/1976 Kim et al. ..... 419/21

FOREIGN PATENT DOCUMENTS 2530704 1/1977 Fed. Rep. of Germany ..... 200/268

*Primary Examiner*—Brooks H. Hunt

*Assistant Examiner*—Joel P. Okamoto

*Attorney, Agent, or Firm*—Donald R. Castle

[57] ABSTRACT

A two-layer contact having a silver backing and a silver cadmium oxide body which backing is relatively free of warpage and macroscopic voids is produced from a mixture of silver oxide, silver acetate and silver.

3 Claims, 3 Drawing Figures

SILVER MATERIAL SUITABLE FOR BACKING OF SILVER-CADMIUM OXIDE CONTACTS AND CONTACTS EMPLOYING SAME

This invention relates to a silver material useful as a backing for silver-cadmium oxide contacts. More particularly, it relates to utilizing powder materials for producing a silver backing having shrinkage characteristics similar to the silver-cadmium oxide body of an electrical contact.

BACKGROUND OF THE INVENTION

Prior to the present invention in the manufacture of silver-cadmium oxide contacts by powder metallurgy, the Ag-CdO powder mix is pressed together with pure silver powder or a mixture of silver powder and a thermally decomposable silver compound to form a two layer composite structure consisting of the Ag-CdO body and a thin backing layer of fine silver. The fine silver backing is required to facilitate bonding of the contact to a support member by a brazing technique. Without the backing layer, the presence of CdO on the brazing surface causes poor wetting of braze metal due to a reaction between CdO and the molten braze metal. In one older method pure silver powder is filled into the pressing die cavity partially filled with the AgCdO mix and these are pressed together. The double layered compact sinters to a non-flat configuration, requiring a subsequent coining or shaping operation. Thermally coarsened silver powder, often used to facilitate powder flow, further aggravates the warpage condition because the thermal coarsening further reduces shrinkage of the silver powder layer relative to Ag-CdO body. However, the use of fine silver powder in the double-fill compacting operation causes warpage of the part during sintering due to a difference in shrinkage rate between Ag-CdO and fine silver. The dissimilar shrinkage arises from the fact that silver powder is compressed to a higher green density than the Ag-CdO mix in the double-fill pressing as a result of a higher compressibility of unmixed silver. During sintering, the higher green density silver layer shrinks less than the Ag-CdO body, causing warpage or bending. Such non-flat condition causes difficulty during subsequent coining to a final contact shape, but more importantly, contributes to part cracking; the severity of which depends on CdO content and the degree of coining needed for final configuration. The coining crack, however minute it may be, is one of the causes of excess erosion leading to early contact failure. Due to tremendous thermal stress generation during arcing and cooling, the crack slowly opens up and propagates through the contact body causing complete separation of a piece of contact. Another older method utilizes mixture of silver powder and a thermally decomposable silver compound, namely silver oxide or silver carbonate, as a backing component in the double-fill press operation. The presence of the decomposable silver compound generates additional porosity during sintering, resulting in additional shrinkage, thereby reducing warpage of the part. Complete elimination of warpage is, however, difficult to achieve since the amount of the poregenerating compound is limited to a certain fraction of the mix. This limitation is dictated by the fact that pressing laminations, blisters, and less than optimum density result when too high a compacting pressure is used in combination with high silver oxide or carbonate content.

U.S. Pat. No. 3,510,935 discloses the use of mixtures of silver and silver carbonate and data is given to show the superiority of these mixtures over silver. In addition, that patent mentions that other gas-evolving, thermally decomposable silver compounds such as silver oxide, silver acetate, silver nitrate and silver oxalate are equivalents of silver carbonate, however, no data is given in regard to the use of any such materials other than silver carbonate.

Recently attempts have been made to reduce the uneven shrinkage of the double layered powder metal contact by using a silver powder mixture for the backing layer, which has a shrinkage characteristic similar to that of the Ag-CdO contact body. This was achieved by incorporating silver acetate, which has high inherent shrinkage, into the silver powder.

The advantage of pressing and sintering a mixture of pure silver and low density silver acetate rather than pure silver and the higher density salts such as silver oxide or silver carbonate to obtain a compatible, structurally sound backing layer has been demonstrated. It is also been found that compatibility with the bulk and as-sintered density improves with increasing silver acetate content up to about 30 wt% silver acetate-balance pure silver. However, with increasing silver acetate content above about 15 wt%, even though the bulk density increases, the distribution of the remaining pore volume changes from a microscopic condition to very small rather spherical macroscopic voids. It is believed that this condition is a result of incipient melting of silver acetate caused by the inhibited ventilation of volatiles from the dense pressed compact during heating. Obviously, the greater the silver acetate content, the greater the probability of this condition occurring.

It is believed, therefore, that it is an advancement in the art to provide a contact having a silver backing relatively free of warpage and relatively free of macroscopic voids.

SUMMARY OF THE INVENTION

In one aspect of the present invention there is provided a powder admixture consisting essentially of from about 1 to about 15% by weight of silver oxide, from about 10 to about 20% by weight of silver acetate and balance silver powder which powder admixture, upon pressing at pressures of from about 8,000 to about 50,000 pounds per square inch, forms a green compact having a density of from about 5.0 g/cc to about 6.5 g/cc. Upon increasing the temperature of the green compact at a rate of about 10° C./minute to about 25° C./minute until about 900° C. is reached and thereafter holding the temperature of the compact relatively stable for at least about 30 minutes, a silver material, having a density of at least about 9.9 g/cc is formed, which material is relatively free of macroscopic voids.

In another aspect of this invention, a process is provided wherein a die is partially filled with a conventional Ag-CdO material to a predetermined level and then the remaining volume is filled with an admixture consisting essentially of from about 1 to about 15% by weight of silver oxide, from about 10% to about 20% by weight of silver acetate, balance silver powder. Thereafter the materials in the die are subjected to compacting pressures of from about 8,000 psi to about 50,000 psi to form a green composite. The green composite is heated at a rate of about 10° C./minute to about 25° C./minute until a temperature of about 900° C. is reached. Thereafter, the temperture is maintained relatively constant for at least about 30 minutes.

In still another aspect of this invention, a two-layer contact having a silver backing and a silver cadmium oxide body is produced which backing is relatively free of warpage and macroscopic voids.

DETAILED DESCRIPTION OF THE PREFERRED EMBODIMENTS

For a better understanding of the present invention, together with other and further objects, advantages and capabilities thereof, reference is made to the following disclosure and appended claims in connection with the above-described drawings.

A backing mixture of silver and silver acetate powders have shrinkage characteristics compatible with Ag-CdO body material for all usable CdO contents and compacting pressures. The inherent decomposition-induced porosity for silver acetate is 79.94% of the starting volume, whereas silver oxide and silver carbonate generate 36.7% and 54.7% pore volume respectively. In addition to large pore generation for additional shrinkage, silver acetate undergoes very slow decomposition over a wide range of temperature below 400° C., well before any appreciable sintering of the decomposition product (silver). Other silver compounds are known to undergo sintering while being decomposed causing entrapment of gaseous decomposition products. According to the differential thermal analysis of silver acetate, this compound has multiple decomposition stages; 180° C., 280° C. and 350° C. As long as the sintering rate during the decomposition is slower than approximately 30° C. per minute and good air flow is provided, the mixture of silver acetate and silver powders sinters to high density without blister formation. For example, a mixture of 23 wt% silver acetate-balance silver powder, which corresponds to 40 wt% silver oxide-balance silver in volume, is pressed to a green density of 5.2 g/cc using 20,000 psi pressure and sintered at 900° C. for 30 minutes. The linear shrinkage of the compact is about 20%. The final density is about 94% of theoretical density. No visible blisters of bloating is observed. The 40 wt% silver oxide-silver mixture when pressed and sintered under the identical condition shows about 15% shrinkage with some degree of blistering. The latter material, when pressed at 40,000 psi, exhibits only 4.5% shrinkage with excessive blister formation and very low density. No blistering is observed with the silver acetate containing mixture processed under the same condition.

Unlike other silver compounds, silver acetate, when mixed with silver powder, shrinks more similarly to the Ag-CdO body regardless of compacting pressure or green density condition. A Ag-CdO part having a green density gradient due to variation in thickness can be sintered warpage-free when the silver acetate-silver mixture is used as a backing layer. This is again due to the fact that the shrinkage characteristics of the mixture follows those of Ag-CdO independent of compacting pressure.

It has been found that by replacing a portion of the silver acetate content with silver oxide, essentially the same pore volume after decomposition is retained with a reduction in the quantity of highly volatile silver acetate.

Figure 1:
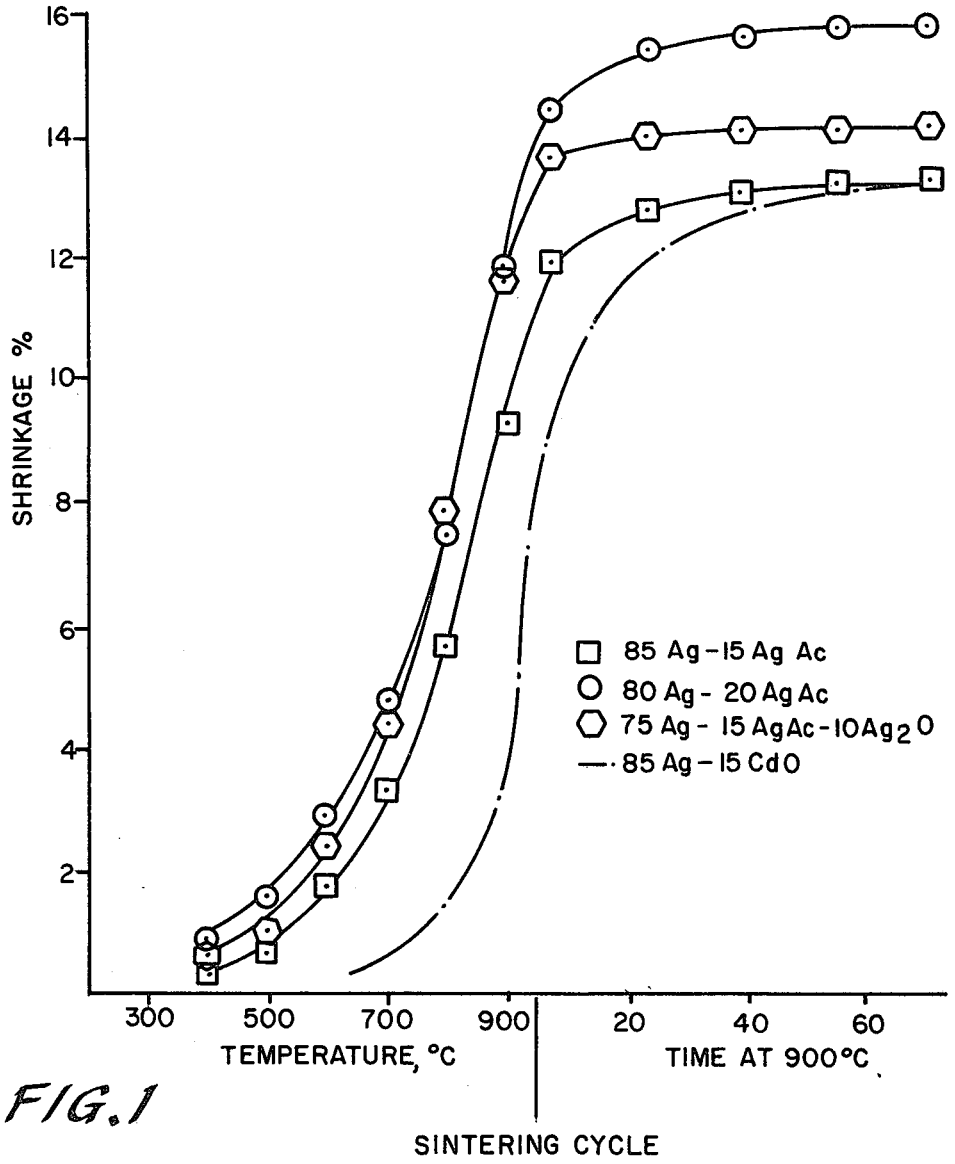
FIG. 1 is a plot of the percent of shrinkage versus temperature and time at temperature.

FIG. 1 shows the sintering character of various silver-silver salt backing material compacts, along with that of an 85 weight percent silver-15 weight percent CdO bulk material compact. Samples are made from the same lots of powder metals and processed in a like manner such that composition is the only variable. As indicated on the FIG. 1, all backing materials are compatible with the bulk, in that the shrinkage of the backing is equal to or slightly greater than that of the bulk.

A mixture of 85 weight percent silver 15 weight percent silver acetate, is pressed at 40,000 pounds per square inch pressure, and a pressed density of about 6.5 grams per cubic centimeter is achieved. After sintering for about one hour at 900° C. in air, about 13.4% linear shrinkage has occurred, resulting in an as-sintered density of about 9.4 gram per cc or about 90% of the theoretical density of pure silver. Increasing the silver acetate content to 20 weight percent balance silver, results in an as-pressed density of about 6.0 grams per cc. due to the greater volume of low density silver acetate. However, the increased pore volume after decomposition permits almost 16% linear shrinkage during sinter, and results in a sintered density of about 9.6 grams per cc or about 92% that of pure silver. This is a significant improvement compared with 85 silver, 15 silver acetate, however, as discussed above, the remaining porosity is isolated in small macroscopic pockets. When a mixture of 75 weight percent silver 15% silver acetate, 10 weight percent silver oxide is compacted at 40,000 psi, the resultant pressed density is about 6.5 grams per cc (comparable to 85 weight percent silver, 15 weight percent silver acetate). The combination of high green density and higher attainable shrinkage during sinter results in an as-sintered density of about 10.0 grams per cc, or about 95% that of pure silver, and there is no evidence of macroscopic porosity. A composition of 80 weight percent silver, 15 weight percent silver acetate, 5 weight percent silver oxide reacts essentially identical to 75 weight percent silver, 15 weight percent silver acetate, 10 weight percent silver oxide. Replacing silver with silver oxide to give 0–5 weight percent silver oxide, 15 weight precent silver acetate-balance silver results in sintered densities intermediate between 85 weight percent silver, 15 weight percent silver acetate and 80 weight percent silver, 15 weight percent silver acetate, 5 weight percent silver oxide.

It is evident that in applications where high compacting pressure (order of 40,000 psi) is required, mixtures of silver and silver acetate are superior to silver and silver oxide or carbonate. In addition, increasing the silver acetate content from 15 to 20 weight percent, improves sintered density, but results in a less desirable pore morphology and distribution. However, replacing a portion of the silver and/or silver acetate with silver oxide, an even further improvement in sintered density is achieved along with a more desirable pore morphology and distribution.

Figure 2:
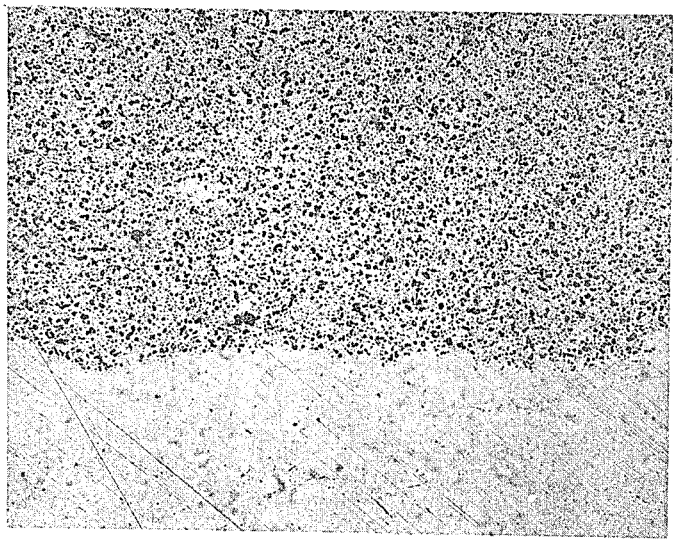
FIG. 2 is a photomicrograph of the cross-section of a Ag-CdO contact having a silver backing of the prior art.

FIG. 2 is a photomicrograph at 250× of a cross-section of a AgCdO contact from which the silver backing is produced from fine silver powder. A photomicrograph of a cross-section of a contact in which the silver backing is obtained from sintering either silver oxide, silver carbonate or mixtures of either of these two decomposable materials and silver would have a similar appearance.

Figure 3:
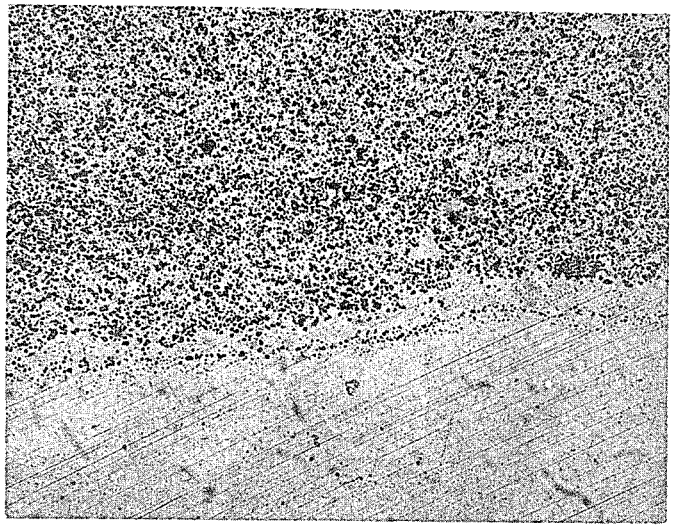
FIG. 3 is a photomicrograph of the cross-section of a Ag-CdO contact having a silver backing produced in accordance with this invention.

FIG. 3 is a photomicrograph at 250× of a cross-section of a AgCdO contact produced in accordance with the present invention.

As shown in FIG. 3, when silver acetate is a component of the backing layer, there is a reaction between the decomposition products of the silver acetate and cadmium oxide at the interface. This reaction is manifested in the finished product as a rather continuous line of very small cadmium oxide particles, which closely follows the contour of the original interface and is a slight distance into the silver backing layer.

While there has been shown and described what are at present considered the preferred embodiments of the invention, it will be obvious to those skilled in the art that various changes and modifications may be made therein without departing from the scope of the invention as defined by the appended claims.

We claim:

1. A process for producing a silver material suitable as a backing for silver-cadmium oxide contact materials comprising (a) forming a relatively uniform admixture consisting essentially of from about 1% by weight to about 15% by weight of silver oxide, from about 10% by weight to about 20% by weight of silver acetate, balance silver powder, (b) pressing said admixture at a pressure of from about 8,000 psi to about 50,000 psi to form a compacted material having a density of from about 5.0 to about 6.5 grams/cc.

(c) heating said compacted material to increase its temperature at a rate of from about 10° C./minute to about 25° C./minute to a temperature of about 900° C., and (d) holding said compacted material at about 900° C. to form a silver material having a density of at a temperature of least about 9.9 grams/cc.

2. A process for producing a two layer electrical contact comprising (a) forming a relatively uniform admixture consisting essentially of from about 1% by weight to about 15% by weight of silver oxide, from abut 10% by weight to about 20% by weight of silver acetate, balance silver powder, (b) forming a silver-cadmium oxide powder material consisting essentially of from about 5% by weight to about 20% by weight of cadmium oxide, balance silver, (c) partially filling a die with said Ag-CdO powder to a predetermined level, (d) completing the filling of said die with said admixture formed in step (a), (e) pressing the material in said die at a pressure of from about 8,000 psi to about 50,00 psi to form a green compact, (f) heating said green compact to increase its temperature at a rate of from about 10° C./minute to about 25° C./minute up to a temperature of about 900° C., and (g) holding said material at a temperature of about 900° C. for at least about 30 minutes.

3. An electric contact produced according to claim 2 wherein said contact has a distinct line of a reaction zone between the resulting silver layer and the silver-cadmium oxide layer.

* * * * *